US005758608A

United States Patent [19]

Berger et al.

[11] Patent Number: 5,758,608

[45] **Date of Patent: *Jun. 2, 1998**

[54] ENGINE BLOCK FOR A MULTI-CYLINDER INTERNAL COMBUSTION ENGINE

[75] Inventors: Frank Berger, Leutenbach; Kurt Moll, Rottenburg, both of Germany

[73] Assignee: Mercedes-Benz AG, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 769,626

[22] Filed: Dec. 18, 1996

[30] Foreign Application Priority Data

Jan. 9, 1996 [DE] Germany ..... 19600566.3

[51] Int. Cl.[6] ..... F01P 11/08

[52] U.S. Cl. ..... 123/41.33; 123/41.74; 123/196 AB

[58] Field of Search ..... 123/41.33, 41.74, 123/196 AB

[56] References Cited

U.S. PATENT DOCUMENTS 5,474,040 12/1995 Murakami et al. ..... 123/41.74

5,558,048 9/1996 Suzuki et al. ..... 123/41.74

FOREIGN PATENT DOCUMENTS

| | | | |
|---|---|---|---|
| 1 488 629 | 6/1967 | France . | |
| 1 193 310 | 5/1965 | Germany . | |
| 1193310 | 5/1965 | Germany | 123/41.33 |
| 40 29 408 | 3/1992 | Germany . | |
| 4029408 | 3/1992 | Germany . | |
| 44 00 952 | 5/1995 | Germany . | |
| 4400952 | 5/1995 | Germany . | |
| 05-321667 | 12/1993 | Japan . | |

*Primary Examiner*—Noah P. Kamen
*Attorney, Agent, or Firm*—Klaus J. Bach

[57] ABSTRACT

In an engine block of a multi-cylinder internal combustion engine with in-line cylinders, a cooling water jacket surrounds the cylinders and is formed between the cylinders and a cooling water jacket wall. A water box is cast integrally with the engine block at one side of the cooling water jacket wall for receiving an oil cooler and the cooling water jacket wall extends at least partially between, and separates, the water space of the water box and the water jacket. The oil cooler is mounted on a cover mounted onto the water box whereby the oil cooler can be mounted onto, and is removable from the water box together with the cover.

6 Claims, 3 Drawing Sheets

ENGINE BLOCK FOR A MULTI-CYLINDER INTERNAL COMBUSTION ENGINE

BACKGROUND OF THE INVENTION

The invention relates to an engine block of a multi-cylinder internal combustion engine including cylinder walls surrounded at least partially by a cooling water jacket and a lubricating oil circuit including an oil cooler mounted on one side of the engine bloc.

DE40 29 408 A1 discloses an engine block of a multi-cylinder internal combustion engine wherein the cylinder walls of the engine block are surrounded by a cooling water jacket extending longitudinally along the engine block and having jacket walls disposed at a distance from the cylinder walls. Mounted onto the cooling water jacket wall on the side of the engine block, there is an oil cooler housing including an oil cooler of the lubricating oil system of the internal combustion engine.

For further general background information references is also made to patent publication DE44 00 952C1.

It is the object of the present invention to provide an engine block which include, integrated in a highly compact arrangement, the oil cooler with the cooling water jacket and the cooling water circuit.

SUMMARY OF THE INVENTION

In an engine block of a multi-cylinder internal combustion engine with in-line cylinders, a cooling water jacket surrounds the cylinders and is formed between the cylinders and a cooling water jacket wall. A water box is cast integrally with the engine block at one side of the cooling water jacket wall for receiving an oil cooler. The cooling water jacket wall extends at least partially between, and separates, the water space of The water box and the water jacket. The water box is closed by a cover on the oil cooler is mounted so that it is disposed in the water box when the cover is mounted onto the water box. The cover further has connections for the admission and removal of lubricating oil to the oil cooler. Also, cooling water inlets are provided at the front end of the engine at the engine block for admitting cooling water to the water jacket and at the water box for admitting cooling water to the water box.

With a water box cast onto the side of the engine block for receiving the oil cooler the arrangement is quite compact. At the same time, the oil cooler with the surrounding water jacket is well integrated into the cooling water circuit of the internal combustion engine, but is still easily accessible and removable as it is mounted onto the cover. Also, the oil is adequately cooled by the direct cooling water supply to the water box.

Preferably, the engine cooling water jacket extends between the top end of the cylinders and the lower end of the cylinder walls undisturbed by the water box so that the cooling water flow and the cylinder cooling remain fully functional. However, the cooling water jacket wall has appropriate openings for flow communication between the cooling water space formed by the jacket and the water box receiving the oil cooler. Depending on the dimensions of the oil cooler and the water box and the flow cross-sections resulting therefrom the cooling water flow in the water jacket may be influenced in the area adjacent the water 1ox.

Preferably, passages are provided between adjacent cylinders which provide for flow communication between opposite water jacket areas. These passages improve the cooling of the cylinders, since heat is also removed from the areas between adjacent cylinders where otherwise relatively high temperature peaks would occur. As a result, the cooling and the heat expansion of the cylinders is more uniform.

It is further advantageous if adjacent the jointure of the water box and the cooling water jacket wall the wall structure has reinforced areas and threaded bores extend through the reinforced wall areas for receiving cylinder head mounting bolts. This permits a relatively simple and inexpensive mounting arrangement for the cylinder head.

With an arrangement wherein the oil cooler is mounted on a removable cover of the water box and all the connections for the oil cooler are also mounted on the cover the oil cooler and the cover can be manufactured as a module. Also, mounting and removal of the oil cooler are greatly facilitated.

Preferably, the engine block with water jacket walls and water box are cast as a single piece by using a single casting core representing the water volume including water box cooling water jacket area and cooling water passages. Such a core can be made as a single piece utilizing for example the Croning form masking process in a simple and inexpensive manner.

Further features and advantages of the invention will become apparent from the following description on the basis of the accompanying drawings.

DESCRIPTION OF A PREFERRED EMBODIMENT

Figure 1:
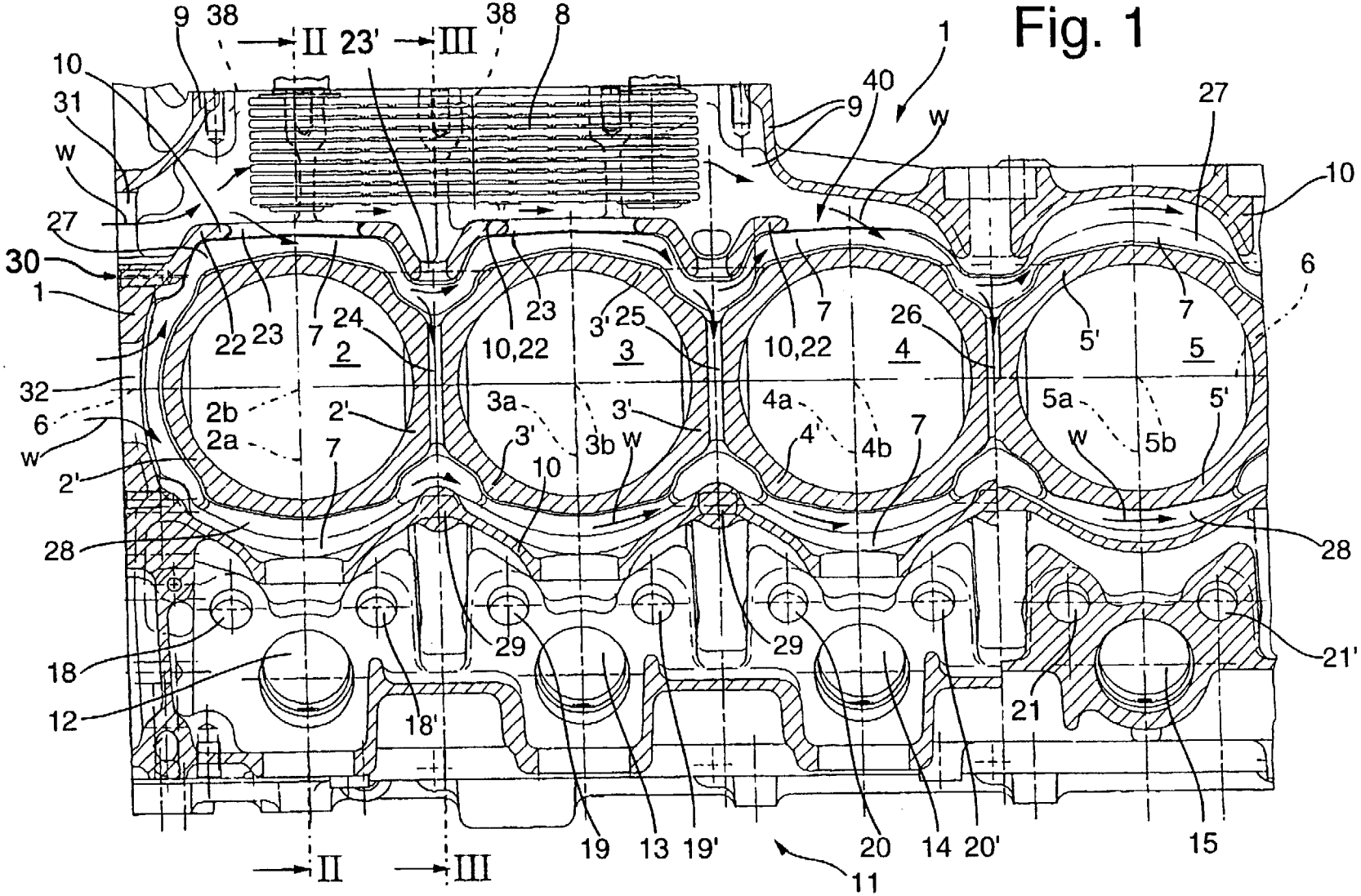
FIG. 1 is a longitudinal cross-sectional view of an engine block with crankcase structure taken in a plane extending normal to the cylinder axes of a multi-cylinder internal combustion engine showing on one side of the cylinders an integrally cast water box with an oil cooler disposed therein.

FIG. 1 shows an engine block 1 of a multi-cylinder internal combustion engine which is not shown in detail. The engine block includes cylinders 2, 3, 4, and 5 formed by cylinder walls 2', 3', 4' and 5' which are surrounded by a cooling water jacket 7 the cooling water jacket 7 is formed by at least one cooling water jacket wall 10 and the cylinder walls 2'–5'. On the side of the engine block 1, there is an oil cooler 8 which is received in a water box 9 integrally cast on one side of the engine block 1. The oil cooler is part of a lubricating oil circuit of tho internal combustion engine which is however basically known and which is therefore not described in detail.

On the side 11 of the engine block 1 opposite the water box 9, there are provided reception bores 12, 13, 14, 15 for plug-in fuel injection pumps which however are not shown. The bores 12, 13, 14 and 15 are arranged in transverse planes receiving the axis of the respective cylinders. They are arranged such that the plunger ends of the plug-in pumps when mounted into the bores are operated by the cams of a cam shaft supported in bearings 16 (see FIGS. 2, 3) on the side of the engine block 1. Between the cylinders 2, 3, 4, and 5 and the associated reception bores 12, 13, 14 and 15 for the plug-in pumps, there are provided passages 18, 18'; 19, 19'; 20, 20' and 21, 21' which are inclined with respect to a plane receiving the cylinder axes and through which the push rods extend which however are not shown. The push rods have their one ends disposed in engagement with cams of the camshaft and their other ends in engagement with rocker arms supported on the cylinder head for the operation of intake and exhaust valves in a manner generally known in the art.

The cooling water jacket 7 is defined by the outer circumference 2'–5' of the cylinder walls and the cooling water jacket wall 10. The cooling water jacket wall 10 extends at a distance from the cylinder walls 2'–5' and in a direction parallel to the cylinder axes 2b–5b and longitudinally along the engine.

A section 22 of the cooling water jacket wall 10 also forms a separation wall between the cylinders and the water box 9. In the section 22, the cooling water jacket wall 10 has openings 23 by which flow communication is provided between the cooling water jacket 7 and the water box 9. Cooling water passages 24, 25, 26 extend through the wall structure between adjacent cylinder walls 2', 3'; 3', 4' and 4', 5'. These cooling water passages provide for fluid communication between the sections 27, 28 of the water jacket 7 disposed on opposite sides of the cylinders in longitudinal direction of the engine. In the areas of the wall sections 22 of the cooling water jacket wall 10 where the water box 9 joins the wall section 22, rib-like wall reinforcement structures 29 (see FIGS. 2, 3) are provided. Threaded bores extend into these wall reinforcement structures 29 for receiving the mounting bolts of a cylinder head which is not shown.

The engine block 1 as shown has the advantage that it can be manufactured by an aluminum die casting process utilizing a single-piece core which represents the cooling water box 9, the cooling water jacket 10 and of the cooling water channels 24–26. Such a core can be made as a single piece by the Croning form masking process.

A water pump which is not shown provides for forced circulation of the water in the cooling water circuit. The water pumped by the water pump enters the engine block 1 at a front end 30 thereof by way of a first inlet 31 leading the water into the water box 9 and by way of a second inlet 32 leading the water to the water jacket 7. The main water flow directions in the water box 9 and in the water jacket 7 are essentially the same. The oil cooler 8 is mounted on a cover 33 of the water box 9 (see FIG. 2) and the connections for the admission of the lubricating oil to be cooled and the removal of the cooled lubricating oil are also mounted on the cover 33. The cover 33 is mounted onto the water box 9 by screws extending into threaded bores formed into reinforcement structures 38 cast onto the walls of the water box 9. The oil cooler 8 is combined with the cover 33 into a single unit so that it can be mounted and removed together with the cover 33.

The cooling water flow through the cooling water jacket 7 and the water box 9 extends from the two front end inlets 31 and 32 as shown in FIG. 1 by the arrows W. The cooling water flows in the water box 9 as well as in the water jacket 7 essentially in the direction of the longitudinal axis 6 of the engine block 1. Along the openings 23 in the cooling water jacket wall 10, there is a certain mixing of the two cooling water flows. Downstream of the oil cooler 8, the water flow from the water box 9 reaches an opening 40 in the water jacket wall 10 through which it joins the cooling water flow along the cylinders. The cooling water flow is indicated mainly to better show the cooling water flow pattern through the engine block 1. Of course, the cooling water flow may be guided in ways other than shown in FIG. 1. It would for example be possible to eliminate the first inlet 31 and provide flow passages which generate cross flows into, an out of, the cooling water box 9. Furthermore, the cooling water can be guided in various ways through the water jacket by appropriately dimensioning the various flow cross-sections of the water channels.

Figure 2:
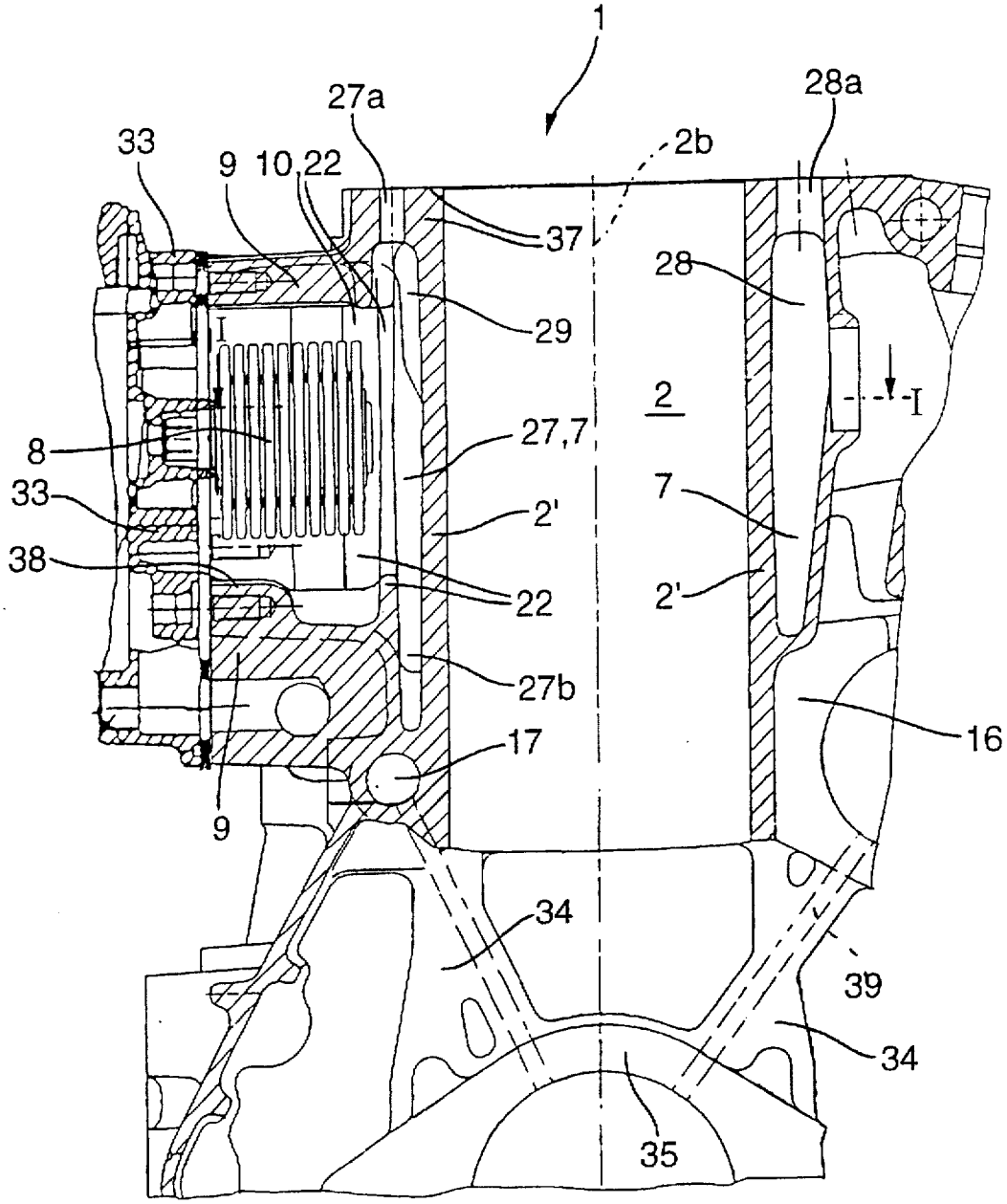
FIG. 2 is a cross-sectional view taken along line II—II of FIG. 1.

FIG. 2 is a cross-sectional view taken along line II—II of FIG. 1. Identical components are designated by the same reference numeral as in FIG. 1. Below the cylinder 2, there is a bearing support structure 34 for a crankshaft bearing 35 of a crankshaft which is not shown. On the right, as shown in FIG. 2 above the bearing support structure 34, there is the bearing 16 for the camshaft which is not shown. Both the camshaft bearing 16 and the crankshaft bearing 35 are being supplied with lubricating oil by way of an oil supply passage 39 which is shown by dash-dotted lines.

The section 27 of the cooling water jacket 7 is disposed along the sides of the cylinders in the direction of longitudinal axis 6 of the engine block 1. It extends essentially parallel to and along almost the full height of the cylinders 2–5.

Near the upper end of the section 27 of the water jacket, there is a passage 27a for each cylinder 2–5 which leads to cooling water channels in the cylinder head. At the lower end, there is a recess 27b which extends downwardly to a point closely adjacent the main lubricating oil conduit 17. The main lubricating oil conduit extends in the engine block 1 in the direction of the longitudinal axis 6 thereof whereby also the lubricating oil in the main lubricating oil conduit is cooled to a certain extent. In particular, the cooling water jacket of the section 22 of the cooling water jacket wall 10 adjacent the water box 9 extends in the cylinder axis 2a or respectively, 2b of the cylinders 2 or 3. In the longitudinal direction of the engine, the cooling water jacket extends from the top end 37 of the engine block 1 to below the water box 9.

Figure 3:
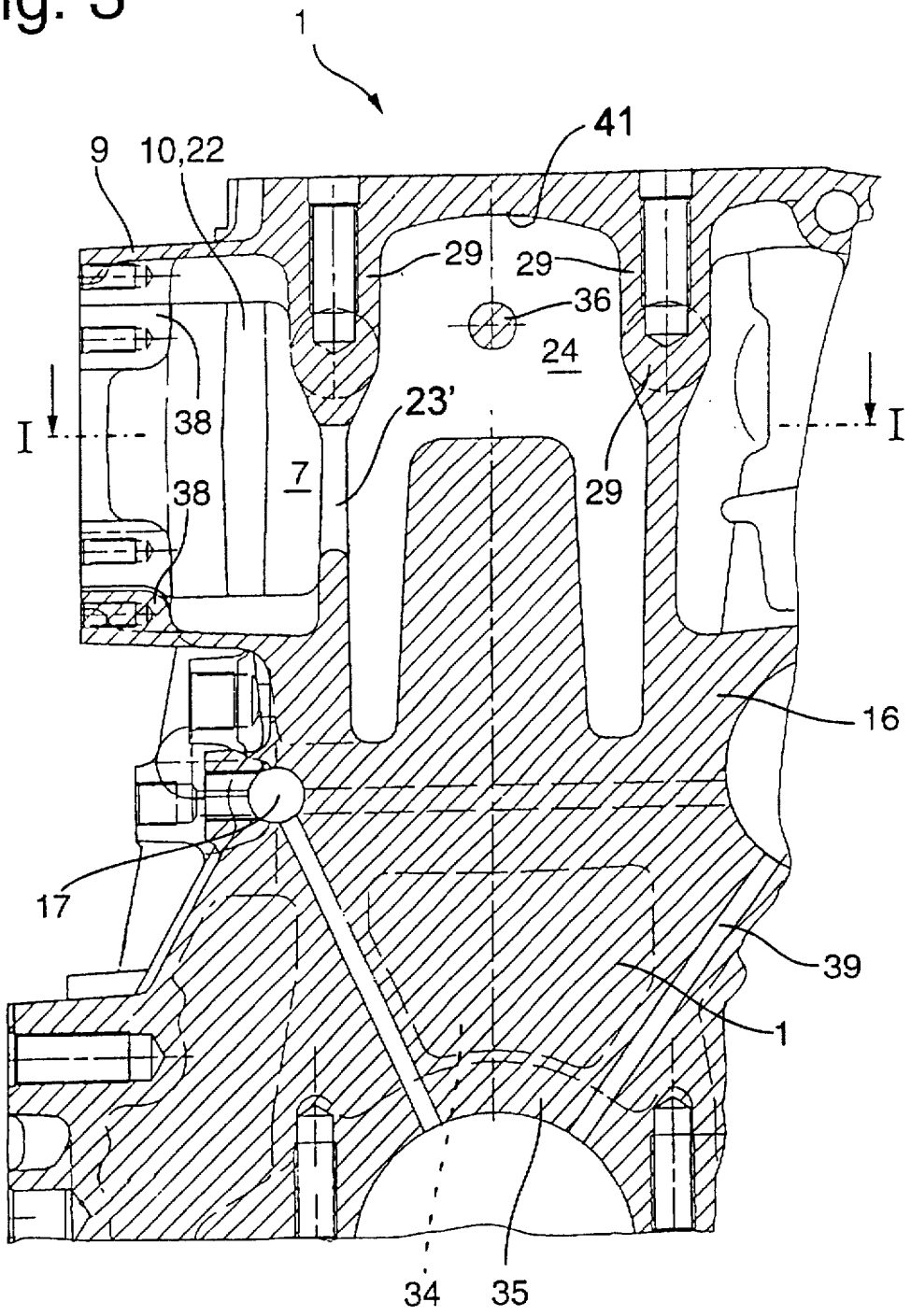
FIG. 3 is a cross-sectional view taken along line III—III of FIG. 1.

Below the flow passage 27a, there is shown the reinforcement structure 29 with the threaded bores for receiving the cylinder head mounting bolts. The reinforcement structure 29 results only in a relatively small reduction in the flow cross-section of the cooling water jacket 7 but it substantially increases the rigidity of the cooling water jacket wall 10. FIG. 3 is a cross-sectional view taken along line III—III of FIG. 1, wherein however, the oil cooler 8 is not shown. Identical components are indicated by the same reference numerals as in FIGS. 1 and 2. On the top side of the engine block 1 adjacent the cylinder head the reinforcement structures 29 for the threaded bores of the bolt connection of the cylinder head are clearly shown. The cooling water passage 24 which provides for flow connection between the two water jacket sections 27 and 28 of the cooling water jacket 7 includes, in addition to the openings 23 to the water box 9 (see FIG. 1), also an opening 23'. The opening 23' is disposed below the reinforcement structure 29 and serves as flow connection to the water box 9.

Between the two reinforcement structures 29, the cooling water passage 24 has at its top end a curved area 41 limiting the water jacket 7. Below the curved area 41 about in middle of the cooling water passage 24, there is a support pin 36 which extends between, and braces, adjacent cylinder walls 2' and 3'(FIG. 1). The support pin 36 is integrally cast with the engine block.

What is claimed is:

1. An engine block of a multi-cylinder internal combustion engine having cylinders arranged in a line, comprising a cooling water jacket surrounding said cylinders and being defined by said cylinders and a cooling water jacket wall extending around said in-line cylinder arrangement, a water box cast integrally with said engine block at one side of said cooling water jacket and defining, adjacent said water jacket, a cooling water space, an oil cooler which is part of an engine lubricating oil circuit disposed in said cooling water space, said cooling water jacket having a wall area extending in the direction of a cylinder axis and in the longitudinal direction of the engine block from a top end of the engine block down to an area below said water box and separating the water space of said water box and said water jacket, a water box cover closing said water box, said oil cooler being mounted on said water box cover, said water box cover further having connections for the admission and removal of lubricating oil to and from said oil cooler said engine block having a front end and a first water inlet being formed in the water box at the front end of said engine block for supplying cooling water to said water box and a second water inlet being formed at the front end of said engine block for supplying cooling water to said cooling water jacket.

2. A cylinder crankcase according to claim 1, wherein, in the area adjacent said water box, said cooling water jacket wall has openings providing for fluid communication between said water jacket and said water box.

3. A cylinder crankcase according to claim 2, wherein said in-line cylinders are cast directly adjacent one another with a common wall formed between adjacent cylinders and cooling water passages extend through the walls between adjacent cylinders of said in-line cylinder arrangement for placing water jacket sections at opposite sides of said inline cylinder arrangement in communication with one another.

4. A cylinder crankcase according to claim 1, wherein said cooling water jacket wall has, in the wall area disposed between said water space and the cooling water jacket, reinforced areas with threaded bores for receiving cylinder head mounting bolts.

5. A cylinder crankcase according to claim 1, wherein at least said cooling water jacket and the water space of said water box form a unitary water core.

6. A cylinder crankcase according to claim 3, wherein the volume of said water box and of said cooling water jacket and also of said cooling water passages comprise a contiguous space which is formed during casting of the cylinder block by a single unitary casting core.

* * * * *